United States Patent [19]

Beitler et al.

[11] 4,440,373

[45] Apr. 3, 1984

[54] FOLIO AND NOTEBOOK DISPLAY STAND

[76] Inventors: Bruce Beitler, P.O. Box 935; Irene Ostendorf, 1203 W. 35th, both of Kearney, Nebr. 68847

[21] Appl. No.: 234,952

[22] Filed: Feb. 17, 1981

[51] Int. Cl.[3] ..... A47B 97/04

[52] U.S. Cl. ..... 248/461; 248/465

[58] Field of Search ..... 248/461, 447, 448, 456, 248/459, 460, 465; 281/33

[56] References Cited

U.S. PATENT DOCUMENTS

| | | | |
|---|---|---|---|
| Re. 21,371 | 2/1940 | Barrett | 248/460 |
| 758,924 | 5/1904 | Law | 248/448 |
| 1,203,659 | 11/1916 | Smith | 248/461 |
| 1,728,431 | 9/1929 | Mevi | 281/33 |
| 1,845,952 | 2/1932 | Wright | 281/33 |
| 2,224,530 | 12/1940 | Weinstein | 248/456 |
| 2,501,019 | 3/1950 | Attick | 248/448 |
| 3,031,247 | 4/1962 | Schieve | 248/461 |
| 3,039,227 | 6/1962 | Buchholtz | 281/33 |
| 3,311,202 | 3/1967 | Schell et al. | 248/461 X |

*Primary Examiner*—Ramon S. Britts
*Assistant Examiner*—Ramon O. Ramirez
*Attorney, Agent, or Firm*—Zarley, McKee, Thomte, Voorhees & Sease

[57] ABSTRACT

A notebook display stand and portfolio is disclosed which consists of a flat portfolio equipped with a collapsible support stand. The support stand is relatively narrow and detachably mounted on the interior surface of the portfolio in alignment with the folding line of the portfolio. The support stand may be erected to form a triangular brace having clips thereon for holding a notebook to be displayed at various angles of inclination. The support stand may be folded flat within the portfolio and may also be detached from the portfolio for independent use.

8 Claims, 6 Drawing Figures

FOLIO AND NOTEBOOK DISPLAY STAND

BACKGROUND OF THE INVENTION

The present invention relates generally to display stands which may be used to support books and the like during oral presentations. More particularly, the invention relates to a display stand which may be utilized in combination with a portfolio as a single compact unit.

During any type of oral presentation, it is often necessary for the person making the presentation to refer to a book or other graphic display device for the purpose of showing various facts and figures. This situation is often encountered during sales presentations where the salesman must show various sales literature to a prospective client. The situation is also encountered by teaching professionals who are asked to give lectures in facilities not equipped with appropriate lecture stands. In this case, the lecturer requires a display device to hold his notes and other teaching materials.

A number of inventions have been patented over the years which attempt to deal with these needs. Babbitt (U.S. Pat. No. 1,086,746) discloses a rectangular briefcase which may be opened and locked into a position wherein the outer sides of the briefcase form a plane surface. Folding legs pivotally attached to the interior of the briefcase are folded out to form a support stand and display material is suspended from the upper portion of the briefcase and supported by the plane surface thereof. Plamondon (U.S. Pat. No. 1,457,458) describes a book folder for supporting reading material at various angles of inclination. The invention consists of two rectangular surfaces slightly larger than the reading material to be supported, which are hinged together along edges of equal dimension. A triangular brace pivotally mounted on one of the rectangular surfaces is used to separate the surfaces at various angles and the surface on which the brace is mounted is equipped with a lip to support a book to be read. Schell et al. (U.S. Pat. No. 3,311,202) discloses a briefcase with a false bottom that is hinged to the upper inside surface of the briefcase. When the briefcase is opened on a horizontal surface, the false bottom may be swung out at various angles of inclination with the briefcase to form a support surface for display materials. The support surface is braced by a pivotal leg mounted on the back of the support surface and attached to the briefcase in various support configurations. Mitchell (U.S. Pat. No. 3,773,154) discloses a briefcase with a table plate for writing and reading. A flat, rectangular briefcase of rigid frame construction having a rectangular recess in one of the side walls has a table plate hingedly supported in the recess, which may be folded out and supported at various angles of inclination by folding strut surfaces pivotally attached to the underside of the table plate.

Although the foregoing inventions provide display surfaces which may be utilized with box-like briefcases there remains a need for a display device which may be used with a flat portfolio-type briefcase. There also exists a need for an easily removable display device which may be detached from a portfolio and used independently where the display surface is not sufficiently large to support the entire portfolio.

SUMMARY OF THE INVENTION

It is the primary object of the present invention to provide a portfolio with a detachable display support stand which may be utilized either in combination with the folio or independently.

It is a further object of the present invention to provide a portfolio with a collapsible support stand.

It is a further object of the present invention to provide a portfolio with a support stand having multiple support positions.

It is a further object of the present invention to provide a portfolio with a support stand having notebook clips.

It is a further object of the present invention to provide a portfolio with a support stand which may be used for sales presentations.

It is a further object of the present invention to provide a portfolio with a support stand which may be used for lectures.

It is a further object of the present invention to provide a portfolio with a support stand which is compact.

It is a further object of the present invention to provide a portfolio with a support stand which is inexpensive to produce.

DESCRIPTION OF THE PREFERRED EMBODIMENTS

Figure 1:
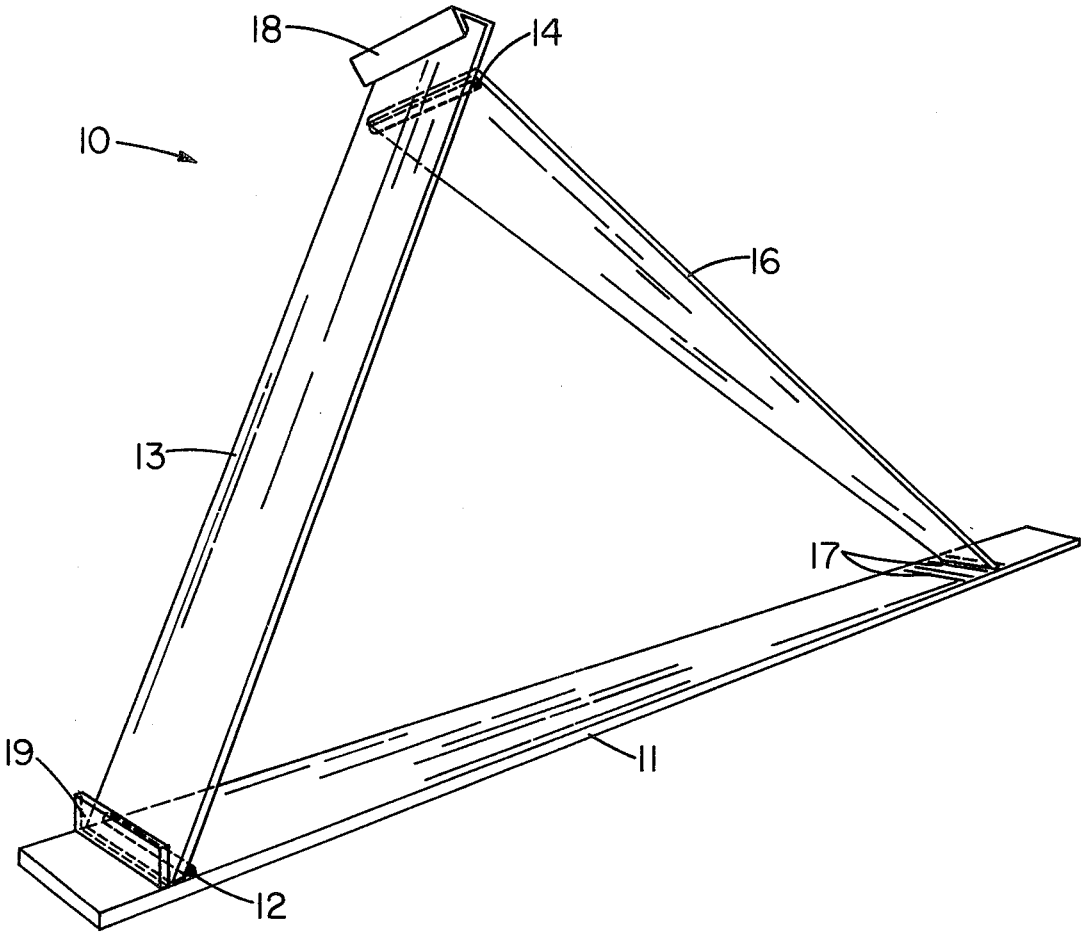
FIG. 1 is a perspective view showing a support stand detached from a portfolio.
Figure 5:
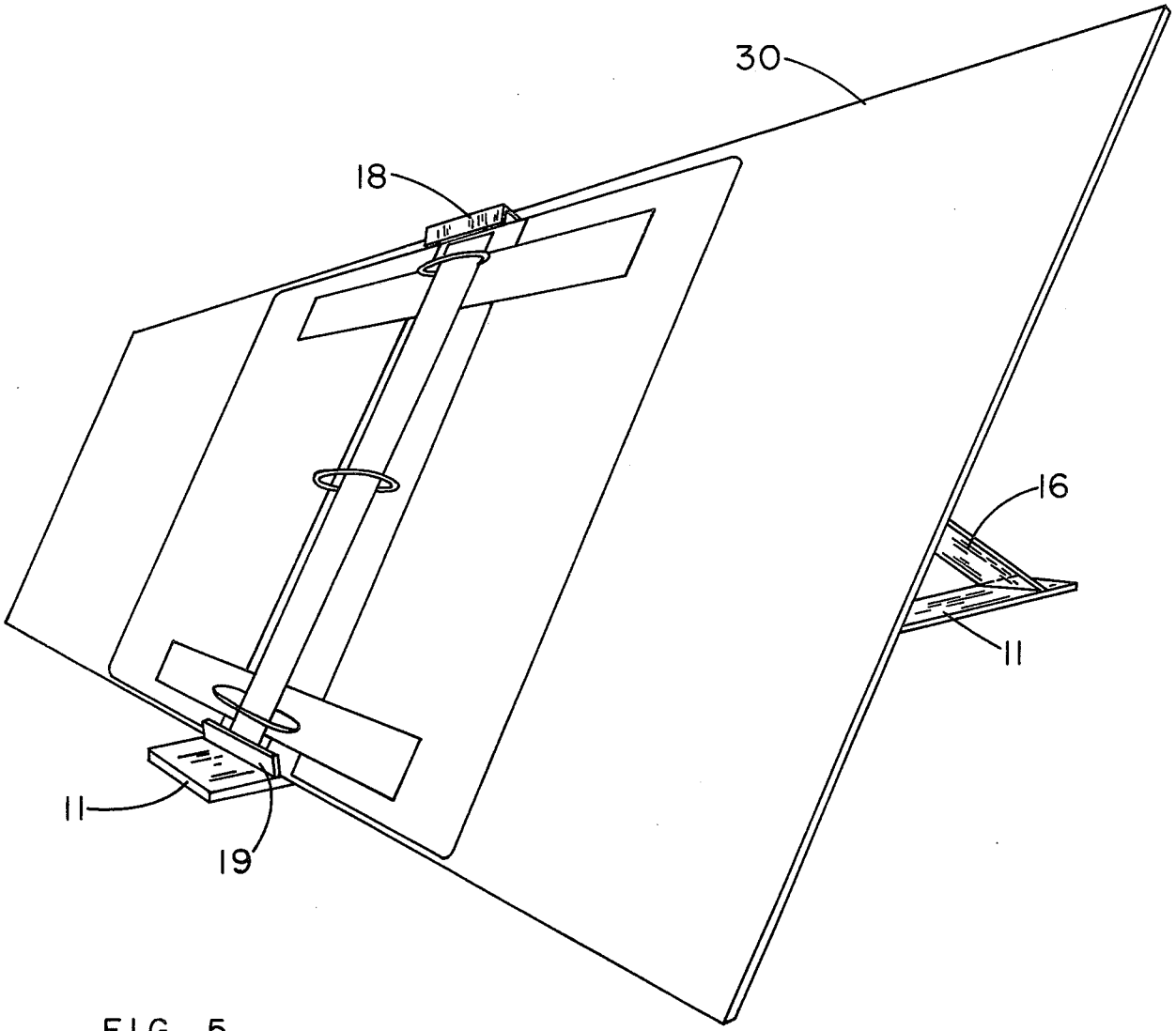
FIG. 5 is a perspective view showing a support stand detached from a portfolio supporting a notebook.
Figure 6:
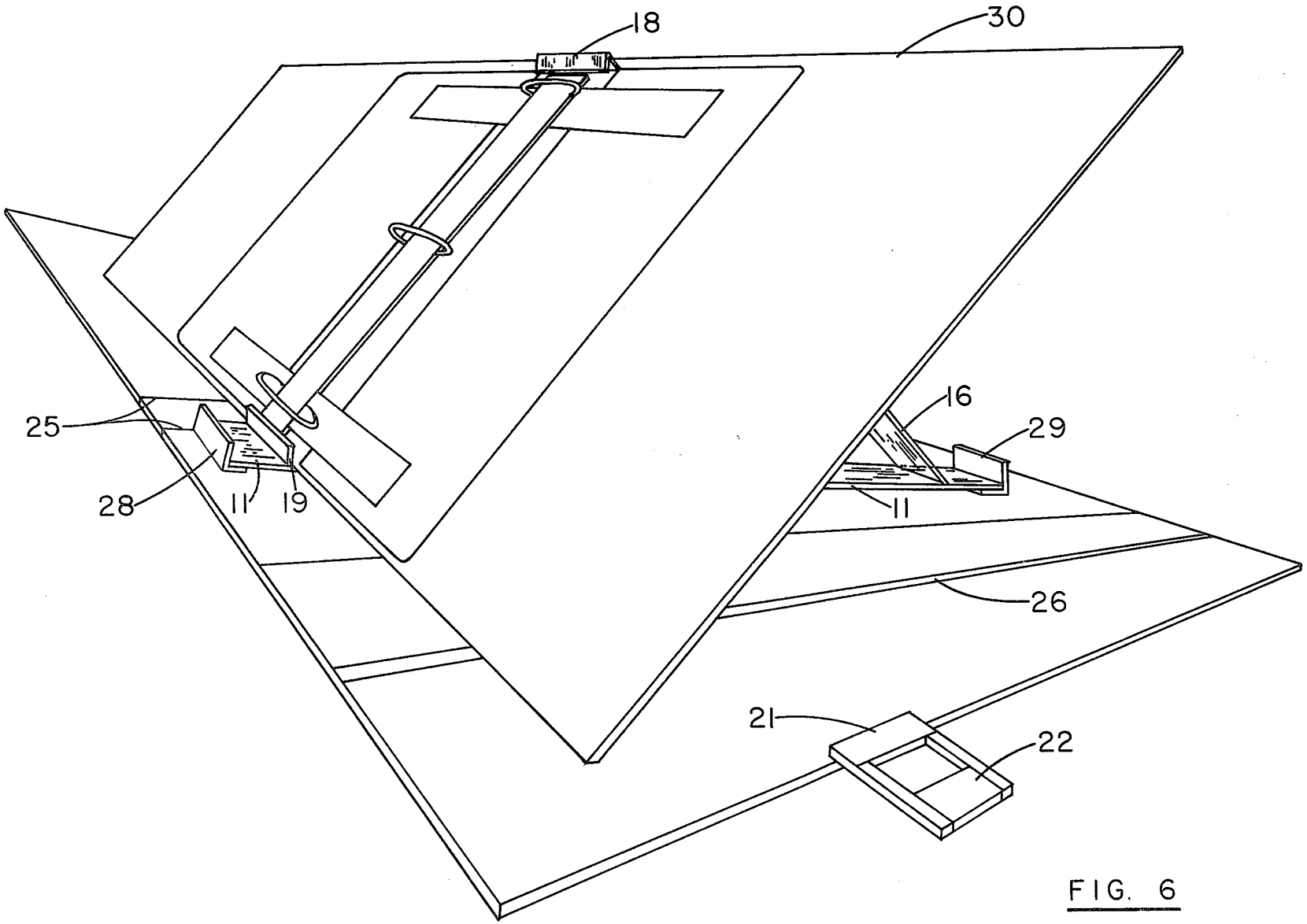
FIG. 6 is a perspective view showing a portfolio with attached support stand supporting a notebook.

It may be seen from FIG. 1 that the support stand 10 consists of a base member 11, support member 13 and brace member 16 interconnected to form a triangular support surface. Each member 11,13 and 16 has a generally flat, elongate shape and in the preferred embodiment is constructed from a metal such as steel or aluminum with high strength characteristics. However, a less expensive version of the invention constructed from high strength plastic would also be feasible. The support member 13 is hinged at one end to the upper surface of the base member 11 by means of a base hinge 12. The brace member 16 is in turn connected at one end to the free end of the support member 13 by means of a brace hinge 14. The longitudinal axis of the three members 11,13 and 16 are coplanar and the pivotal connection of the support member 13 to the base member 11 and brace member 16 allows the lower end of the brace member 16 to be moved to various positions along the base member 11. Transverse slots 17 located at various positions along the base member 11 are adapted to accept and hold the end of the brace member 16 thus allowing the support member 13 to be positioned at various angles of inclination. Notebook clips 18 and 19 positioned at the upper end of the support member are adapted to accept and firmly hold a conventional three ring notebook as shown in FIGS. 5 and 6. Display boards (not shown) or other display materials could, of course, also be held in position by the clips. It may also prove desirable to provide a support member 13 with slideably moveable clips 18,19, which may be moved to various positions along the support member 13 in order to accomodate various size display materials. Thus, in the preferred embodiment, support member 13 has a length approximately equal to that of a conventional three ring notebook, however, in other embodiments, a support member 13 of greater length having slideable clips 18 and 19 would be required.

Figure 2:
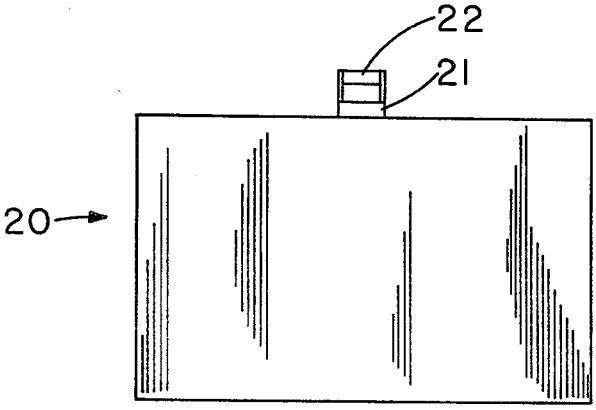
FIG. 2 is an elevation view of a portfolio briefcase containing a support stand.
Figure 3:
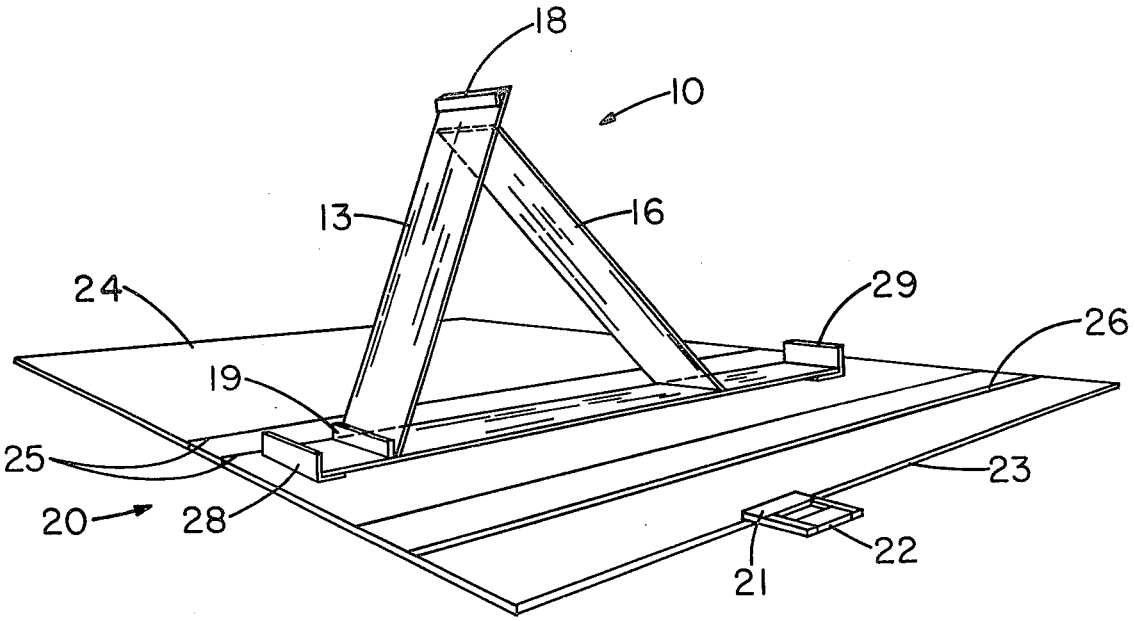
FIG. 3 is a perspective view showing a portfolio with a support stand in a raised position.
Figure 4:
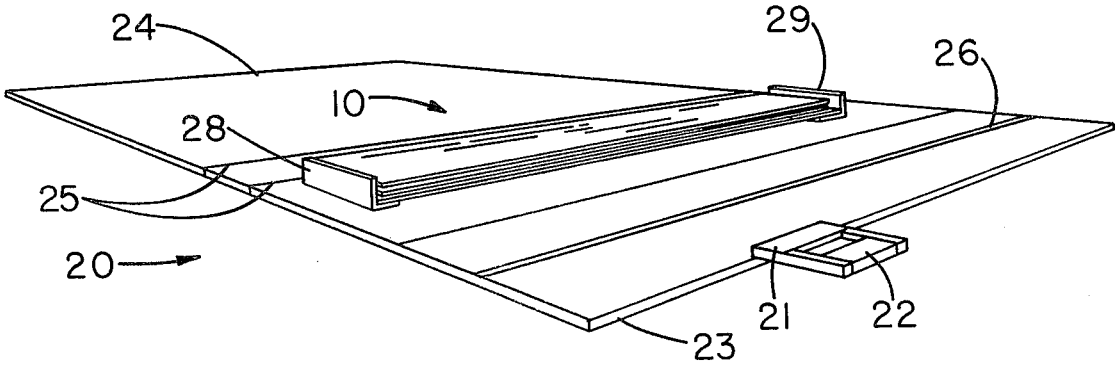
FIG. 4 is a perspective view showing a portfolio with support stand in folded position.

The conventional portfolio briefcase 20 having two symmetrical folding surfaces is shown in closed position in FIG. 2. As may be seen from FIGS. 2, 3 and 4, the portfolio has a clip 21 positioned along the upper surface 23 of one of the folding members which co-acts with the upper end 24 of the other folding member to hold the portfolio in closed position. A handle 22 attached to the upper surface of the clip 21 allows the portfolio 20 to be carried in an upright position. A paper pouch 26 is provided for holding various flat display materials, as shown in FIGS. 3 and 4. Support stand clips 28 and 29 are positioned transversely near the folding line of the portfolio 20 and are adapted to accept and firmly hold the support stand 10. The clips 28 and 29 are preferably of metallic construction and are riveted or otherwise conventionally attached to the surface of the portfolio 20. In the preferred embodiment, the clips 28 and 29 are bent outward to accept the ends of the base member 11, however, other methods of detachably clipping the support stand 10 to the portfolio 20 would also be feasible and are within the scope of the invention. As shown in FIG. 4, the support stand 10 may be collapsed into a relatively flat position between the clips 28 and 29 which then allows the portfolio 20 to be closed, as shown in FIG. 2. In the preferred embodiment, the support stand 10 is collapsed by detaching the brace member 16 from its support slot 17 and rotating the lower end of the brace member 16 towards the lower end of the support member 13 until the surfaces of the two members 13 and 16 come into contact. The two members 13 and 16 are then pivoted about the base hinge 12 axis to a lowered position wherein the lower surface of the brace member 16 contacts the upper surface of the base member 11, as shown in FIG. 4. Means for holding the support stand may be separately provided, however, in the preferred embodiment, the support stand is held in a closed position by the sides of the portfolio 20 when it is closed.

It can be seen from the above description that a collapsible support stand 10 has been provided which will effectively provide support for display material. Although the support stand is provided additional lateral stability when supported by the folio and support stand clips 28 and 29, it may also be detached from the folio 20. It may then be supported on any flat surface and may be used to hold various display materials. The invention is of particular importance to sales personnel who are often required to display a variety of different notebooks and material to different clients. Using this particular invention any number of notebooks may be carried independently of the invention and taken to an interview with a particular client. The portfolio may be placed in an open position on any conventient table or flat surface and the support stand 10 quickly raised. After initially determining the appropriate material for a particular client, the correct notebook may then be clipped to the stand and displayed to the client. A similar procedure may be followed by a lecturer to support his own lecture notes and reading material in a classroom which is not equipped with proper lecturing facilities.

Although specific components and steps have been stated in the above description of the preferred embodiments of the invention, other suitable materials, and process steps may be used with satisfactory results with varying degrees of quality. In addition, it will be understood that various other changes of the details, materials, steps, arrangements of parts, and uses which have been herein described and illustrated in order to explain the nature of the invention will occur to and may be made by those skilled in the art, upon the reading of this disclosure. Such changes are intended to be included within the principles and scope of this invention as claimed.

We claim:

1. A notebook display stand and portfolio, comprising a portfolio having two folding panels hingedly connected along a folding line therebetween, a collapsible triangular frame for supporting a notebook at an inclined position, a detachable frame mounting means on said portfolio for allowing detachment of said frame from said portfolio, said frame comprising an elongated base member operably attached to said portfolio by said detachable frame mounting means, an elongated support member, for supporting a notebook, having one end hingedly connected to said base member and an opposite free end, and an elongated brace member having one end hingedly connected to the free end of the support member and a lower end detachably connectable to the base member, said base member being longer than said support member which is longer than said brace member, said brace member being foldable into generally parallel alignment against said support member which is foldable into generally parallel alignment against said base member upon collapsing of said frame.

2. The notebook display stand and portfolio of claim 1 wherein said panels may be openly positioned on a flat surface whereby a folio plane is defined.

3. The notebook display stand and portfolio of claim 2 wherein said frame further comprises notebook clip means mounted on said elongate support member for detachably holding a notebook in a stable, open position on said frame means.

4. The notebook display stand and portfolio of claim 3 wherein the longitudinal axis of said base member, said support member, and said brace member lie within a frame plane.

5. The notebook display stand and portfolio of claim 4 wherein said frame plane is perpendicular to said folio plane and parallel to said folding line.

6. The notebook display stand and portfolio of claim 5 wherein said detachable frame mounting means comprises frame clips fixedly positioned on said folio.

7. The notebook display stand and portfolio of claim 6 wherein said brace member is detachably connectable to said base member by means of slots in said base member adapted for coacting with said lower end of said brace member.

8. The notebook display stand and portfolio of claim 7 wherein said base member, support member and brace member are substantially planar and wherein the plane of each member is perpendicular to said frame plane.

* * * * *